US011303997B2

(12) United States Patent
Krüger et al.

(10) Patent No.: US 11,303,997 B2
(45) Date of Patent: Apr. 12, 2022

(54) METHOD FOR CONTROLLING A MICROPHONE ARRAY AND DEVICE FOR CONTROLLING A MICROPHONE ARRAY

(71) Applicant: Sennheiser electronic GmbH & Co. KG, Wedemark (DE)

(72) Inventors: Alexander Krüger, Burgdorf (DE); Renato Pellegrini, Niederhasli (CH)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 17/121,833

(22) Filed: Dec. 15, 2020

(65) Prior Publication Data

US 2021/0185433 A1 Jun. 17, 2021

(30) Foreign Application Priority Data

Dec. 16, 2019 (DE) ..... 102019134541.3

(51) Int. Cl.
*H04R 1/40* (2006.01)
*H04R 1/20* (2006.01)
(Continued)

(52) U.S. Cl.
CPC ..... *H04R 1/406* (2013.01); *H04R 1/20* (2013.01); *H04R 3/005* (2013.01); *H04R 2430/20* (2013.01); *H04R 2430/23* (2013.01)

(58) Field of Classification Search
CPC .... H04R 1/406; H04R 3/005; H04R 2430/23; H04R 1/20; H04R 2430/20
(Continued)

(56) References Cited

U.S. PATENT DOCUMENTS 6,914,854 B1 7/2005 Heberley et al.
2004/0175006 A1 * 9/2004 Kim ..... H04R 3/005 381/92
(Continued)

FOREIGN PATENT DOCUMENTS

EP 2 942 975 11/2015
WO WO 2007/037700 4/2007
WO WO 2019/211487 11/2019

OTHER PUBLICATIONS

Extended European Search Report for Application No. EP 20209487.6 dated May 31, 2021.
(Continued)

*Primary Examiner* — Paul Kim
*Assistant Examiner* — Douglas J Suthers
(74) *Attorney, Agent, or Firm* — Haug Partners LLP

(57) ABSTRACT

In order for a microphone array to capture sound emanating from a moving object whose exact position is unknown at the time of arrival of the sound signal, a method for controlling the microphone array comprises steps of receiving position information that includes a position ($p_{TR}$) and a velocity of the moving object from a tracking system, receiving a plurality of microphone signals that comprise sound of a sound event emanating from the moving object from a plurality of microphone capsules, calculating a directional characteristic from the plurality of microphone signals, wherein the directional characteristic is based on beamforming according to the position information and wherein an audio output signal is generated that includes the sound from a preferred direction of high sensitivity, and providing the audio output signal at an output. A beam width or opening angle ($\alpha$) of the directional characteristic varies over time and depends on the velocity of the moving object,
(Continued)

wherein a higher velocity of the moving object results in a larger beam width or larger opening angle respectively.

12 Claims, 3 Drawing Sheets

(51) Int. Cl.
*H04R 3/00* (2006.01)
*H04R 1/32* (2006.01)

(58) Field of Classification Search
USPC ..... 381/92
See application file for complete search history.

(56) References Cited

U.S. PATENT DOCUMENTS

| | | | | |
|---|---|---|---|---|
| 2007/0003074 | A1* | 1/2007 | Ruwisch | G10L 21/02 381/92 |
| 2010/0220877 | A1* | 9/2010 | Ishibashi | H04R 1/403 381/170 |
| 2018/0156887 | A1* | 6/2018 | Qiu | G01S 3/802 |

OTHER PUBLICATIONS

German Search Report for Application No. DE 10 2019 134 541.3 dated Sep. 7, 2020.

* cited by examiner

METHOD FOR CONTROLLING A MICROPHONE ARRAY AND DEVICE FOR CONTROLLING A MICROPHONE ARRAY

CROSS REFERENCE TO RELATED APPLICATION(S)

This application claims the benefit of the foreign priority of German Patent Application No. 10 2019 134 541.3, filed on Dec. 16, 2019, the entirety of which is incorporated herein by reference.

FIELD OF DISCLOSURE

The present principles relate to a device for controlling a microphone array and to a method for controlling a microphone array.

BACKGROUND

For capturing individual acoustic events in a large planar-like detection area in the presence of a high level of interference noise, WO2019/211487A1 proposes a microphone arrangement consisting of a circular arrangement of shotgun microphones that point radially outwardly. Since for planar acoustic detection areas no time-variant control of the audio beam along the dimension perpendicular to the plane of detection is required, the microphone array uses directly the directivity of the microphones as a fixed directivity with respect to this dimension. With respect to the dimension of the plane, however, such array allows a time-variant acoustic beam steering with an almost constant beam pattern in all directions.

A typical example of such a large planar-like detection area that simultaneously has a high level of interference noise is a sports field, where individual ball kick sounds or the sound of a referee whistle are to be captured, for instance during a soccer match. For such a task, the possible detection area is the soccer field. In addition, there is typically a high level of background noise during a game in a sports stadium, which emanates mainly from the stands around the playing field. A peculiarity of ball sports in general is the fact that both the ball and the players usually move very quickly, so that the beam steering needs to be fast in order to be able to capture the ball kick sound. The microphone array should not be positioned on the playing field, but may be e.g. on the edge of the field.

If the position of the acoustic target relative to the position of the array can be automatically tracked (e.g. by visual tracking using video cameras), the beam steering can be accomplished in a fully automated way, avoiding the need of a human operator. An automatic tracking system or tracker may in this case provide so-called tracking data, i.e. position data and velocity data of various target objects. The most important target object in this context is the ball. However, the following problems arise.

First, the tracking data have a latency and an uncertainty of this latency. The tracking data for controlling the direction of the beam are usually provided with a certain latency, which is caused for instance by image processing algorithms applied in the context of visual tracking or by transmission of the tracking data itself from the tracking system to the microphone array. For the case of moving sound objects to be captured with the microphone array this means that by the time the information about the object position arrives at the microphone array, the object is usually already located at a different position, which results in a mismatched beam steering. Typically, the latency of the tracking data is time-invariant and, what is even more important, not precisely known.

Second, there is an uncertainty in the tracking data accuracy: tracking systems are usually not able to provide the exact position of the tracked objects, but they provide the position only with a certain positional accuracy instead, for instance in the form of a confidence interval.

Third, sound propagation is associated with a delay. The sound needs a certain time to propagate from the object triggering the sound event to the microphone arrangement. Assuming that the sound objects to be captured are moving within a certain maximum distance from the array (e.g. up to 50 m), this effect can be regarded as a kind of "negative latency" with respect to the tracking data processing, requiring the beam steering to wait until the sound corresponding to a certain position has arrived at the microphone array. In contrast to the tracking data latency, the negative latency due to the sound propagation is time-variant, since it corresponds to the distance between the sound object and the microphone array.

Both effects result in a poor capture quality of the sound object, since the beam direction is not correctly time-aligned (for instance, the beam is directed into a certain direction too late or too early).

A suboptimal solution for the problem of tracking data latency in a real-time capturing system consists in simply delaying the audio signal by the expected mean latency before applying beam forming. This solution, however, does not consider uncertainties in the latency of the tracking data nor time-variant object-to-array distances. These effects often result in a temporal misalignment, that is, a difference between the set direction and the actual direction of the sound object to be captured in this moment.

SUMMARY OF THE INVENTION

The present invention solves at least this problem. In one embodiment, the invention relates to a method for controlling a microphone array. In another embodiment, the invention relates to a device for controlling a microphone array. In yet another embodiment, the invention relates to a non-transitory computer-readable storage medium having stored thereon instructions that when executed on a computer cause the computer to execute the steps of the method. Further advantageous embodiments are disclosed in the following description and the dependent claims.

According to the invention, the latency (including the uncertainty of the latency) of the tracking data and the sound propagation are accounted for by changing the width of the steered audio beam temporally. The beam is steered to be as narrow as possible, but as wide as necessary for fully and securely capturing the desired object sound. This creates a time-variant beam width control for the microphone array, where the width of the beam depends from at least the following parameters: the tracking data, i.e. the velocity of the moving object and its distance to the microphone array, and the tracking latency, i.e. the time the tracking data need to arrive at the microphone array. This allows to securely capture the sound of a sound event triggered by the moving object.

BRIEF DESCRIPTION OF THE DRAWINGS

Further details and advantageous embodiments are depicted in the drawings, in which.

DETAILED DESCRIPTION OF PREFERRED EMBODIMENTS

Figure 1:
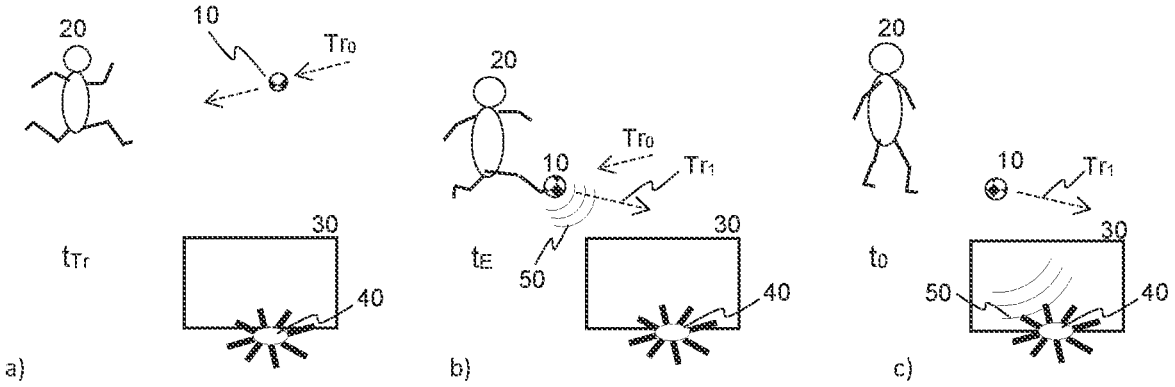
FIG. 1 illustrates a sketched sequence of position measurement, sound event and arrival of the sound and the position data at the microphone array.

FIG. 1 shows a sketched sequence of position measurement, sound event and arrival of the sound and the position data at the microphone array, exemplarily for a soccer game. In FIG. 1 *a*), a ball 10 at a first point in time $t_{TR}$ has a certain position on a playing field and a velocity along a trajectory $Tr_0$, along which it is moving, as detected by an automatic video tracking system (not shown). However, the tracking data are not yet available at this point in time. A microphone array 40 is positioned outside the playing field, e.g. behind a soccer goal 30. Optionally, the video tracking system may further measure positions and/or velocities of players 20 or of a referee.

In FIG. 1 *b*), the player 20 hits the ball 10 at a second point in time $t_E$ that is initially unknown, creating a sound event whose sound waves 50 are to be captured by the microphone array 40. The ball changes its direction, following for instance the new trajectory $Tr_1$. The sound waves need some time to arrive at the microphone array 40. At the time $t_0$ the microphone array 40 receives the tracking data, as shown in FIG. 1 *c*). In this first example, this is also assumed to be the point in time at which the sound waves 50 arrive at the microphone array 40 (or at a connected processing device, not shown). Thus, the microphone array 40 directs its beam accordingly so as to specifically capture the sound waves 50 of the sound event. Advantageously, the beam can be steered with virtually no delay. Alternatively, in an equivalent case with an external processing device that also receives the tracking data, the microphone array sends sound data of the captured sound to the external processing device, where the actual beamforming is performed.

However, the tracking data relate to the ball position at the time $t_{TR}$ while the sound waves were created by the sound event at the time $t_E$. If the sound travelling time equals the tracker latency, both match. Otherwise, the sound event was created at another position at an earlier or later time $t_E$. Since the position, the trajectory $Tr_0$ (i.e. direction) and the velocity of the ball at $t_{TR}$ are known from the tracking data, and since the tracking latency is also known and a tracking accuracy can at least be estimated, the ball position at the time $t_E$ can be calculated.

If the distance between the position provided by the tracking system and the microphone array is larger than a maximum value $r_{MAX}$, the sound cannot travel this distance within the latency of the tracking system. Thus, the tracking data relating to the sound event have in this case already arrived at the microphone array 40 (or at the external processing device, respectively) when the sound waves 50 arrive. This distance results from $r_{MAX}=v_S*d_{TRACK}$ (with $v_S$ being the speed of sound and $d_{TRACK}$ the tracking latency). That is, FIG. 1 *c*) shows a borderline case if $t_{TR}=t_E$, meaning that the sound waves 50 and the tracking data relating to the sound event at $t_E$ arrive simultaneously at the microphone array or the external processing device. However, if the distance is larger, the tracking data arrive before the sound waves. The object 10 actually had the position $p_{TR}$, which is provided by the tracking system at the time $t_0$, at the time $t_{TR}=t_0-d_{TRACK}$. The sound (in the case $r>r_{MAX}$) will arrive at the microphone array at a later time $t_S=t_0-d_{TRACK}r/v_S$ than the tracking data (that is, $t_S>t_0$). Therefore, the array receives already at a time to the information where the audio beam should sensibly be directed at a later time $t_S$ in order to capture the sound of the acoustic object or sound event. Therefore, this information is temporally stored in an appropriate way between $t_0$ and $t_S$. Since the position of each possible acoustic object or sound event is known in advance in this case, and assuming exact knowledge of the tracker latency and an error-free position detection by the tracking system, the acoustic beam for detected positions at a distance equal to or larger than $r_{MAX}$ can be made narrower as with conventional methods. In particular, it is made as narrow as possible.

Moreover, there may be cases where the latency of the tracking system is not exactly known or the position data coming from the tracking system are erroneous. In such cases, a maximum possible latency may be given as an upper limit. Thus, also in these cases the width of the acoustic beam can be controlled adaptively in order to account for these uncertainties. Generally it makes sense then to increase the beam width; the faster the object causing the sound event moves and the smaller the distance between the object and the microphone array is, the larger the beam width should be.

However, a case where the distance between the position detected by the tracking system and the microphone array is smaller than the maximum value $r_{MAX}$ is critical. This case is considered in the following.

Figure 2:
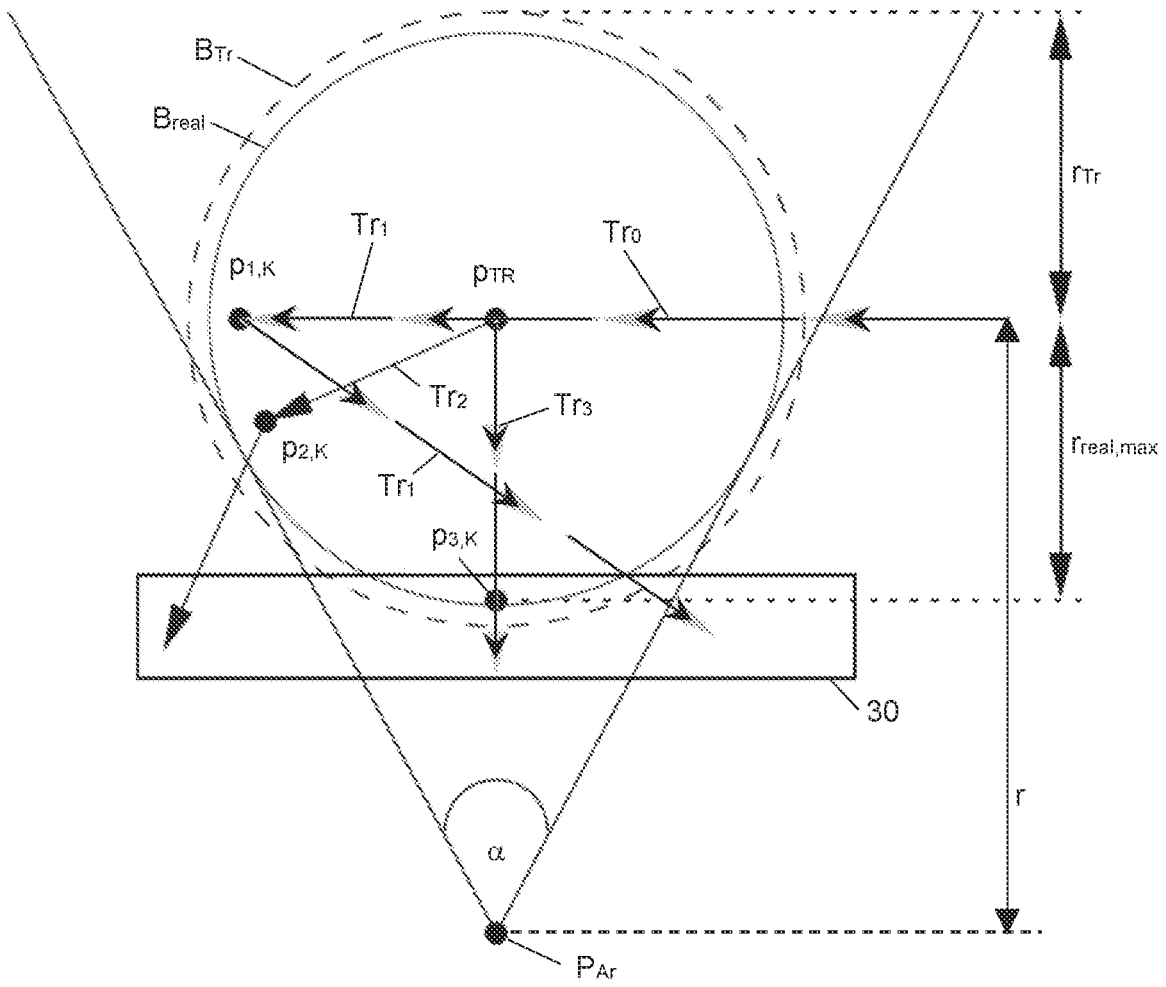
FIG. 2 illustrates a top view of a playing field in a first situation.

FIG. 2 shows a top view on a playing field in a first situation. The aim is to capture a ball kick sound with a microphone arrangement that is positioned at a point $P_{Ar}$, 3 m behind the goal 30, for instance. At a certain time $t_0$ a tracking system for ball tracking provides an estimated ball position $p_{TR}$ for instance at a distance to the array of r=6 m, and an estimated velocity $v_{BALL}$ of the ball which may be for instance 30 m/s at this time. However, the direction in which the ball moves is not necessarily known. Further, it is known that the tracking system has a latency $d_{TRACK}$ which may be 0.1 s (seconds), for instance. After the tracking time point $t_{TR}$, a player hits the ball at an event time point $t_E$. This deflects the ball and creates the ball kick sound, i.e. the sound event to be captured. FIG. 2 shows three possible flight paths of the ball along different trajectories $Tr_1$, $Tr_2$, $Tr_3$ that lead to the ball kick sound being created at different positions, wherein the sound waves of the ball kick noise arrive at the array at a time $t_0$, taking into account the propagation of sound through the air. It is assumed here that the ball has the same velocity $v_{BALL}$ on all three possible flight paths. The corresponding positions where the ball kick event may take place are marked $p_{1,K}$, $p_{2,K}$ and $p_{3,K}$. It is therefore a challenge for the beam width control to securely capture the sound of the ball kick noise while simultaneously keeping the beam as narrow as possible in order to suppress as good as possible the ambient noise, such as e.g. the diffuse noise of the spectators. Therefore, at the time $t_0$ of arrival of the tracking data, first an area $B_{Tr}$ of the possible true ball position at the tracking time $t_{TR}$ is determined, depicted as a dashed circle in FIG. 2. Its radius $r_{Tr}$ of e.g. 3 m results from the ball movement, starting from the tracking position $p_{TR}$, for the time $d_{TRACK}$ of the tracking latency with a velocity $v_{BALL}$. Without considering the sound propagation from the ball kick position $p_{1,K}$, $p_{2,K}$, $p_{3,K}$, that is the actual place of the sound event, to the microphone array, a simple selection of the beam width might be as narrow as possible for capturing the dashed circle. However, this approach would overestimate the actually required beam width and thus be unnecessarily inaccurate.

If however the sound propagation from the ball kick position to the array is taken into account, a narrower beam width that is sufficient can be calculated. In particular, for all possible ball kick positions $p_{1,K}$, $p_{2,K}$, $p_{3,K}$ there exists a minimum time duration $d_{AIR,min}$ that the ball kick sound needs for propagating through the air to the microphone array. Accordingly, there is a maximum time duration $d_{BALL,max}$ in which the ball has moved before being kicked such that the sound created by the kick arrives at the array at the time $t_0$. Both cases occur together if the ball moves from the tracking position $p_{TR}$ along the trajectory $Tr_3$ directly towards the array and is kicked on this path at a distance $r_{real,max}$ from the tracking position $p_{TR}$. The distance $r_{real,max}$ may be derived from the fact that the sum of both time durations, $d_{BALL,max}$ ($=t_E-t_{TR}$) and $d_{AIR,min}$ ($=t_0-t_E$), must equal the tracker latency in order for the sound of the ball kick to arrive at the array at the time $t_0$, i.e.

$$d_{BALL,max}+d_{AIR,min}=d_{TRACK} \tag{1}$$

Expressing the time durations by the corresponding distances and velocities according to $$d_{BALL,max}=r_{real,max}/v_{BALL} \tag{2}$$

$$d_{AIR,min}=(r-r_{real,max})/v_S \tag{3}$$

wherein $v_S$ denotes the speed of sound and r denotes the distance between the microphone array and the tracking position, and solving for $r_{real,max}$ results in $$r_{real,max}=\frac{v_S\cdot v_{BALL}\cdot d_{TRACK}-v_{Ball}\cdot r}{v_S-v_{BALL}} \tag{4}$$

where $r_{real,max}\approx 2.71$ m results with the exemplary numbers mentioned above. This is the radius of a circular area $B_{real}$ around a center $p_{TR}$ that represents the real area of uncertainty of the ball kick position; it is smaller than the dashed circle $B_{Tr}$. Thus, the ball kick noise is securely captured if the beamformer at the time $t_0$ (i.e. when the tracking data arrive) is steered to generate a beam as narrow as possible for covering the smaller circle $B_{real}$. In the situation described above and shown in FIG. 2, a beam width with an azimuthal angle of $\alpha=\sin^{-1}(r_{real,max}/r)\approx 54°$ results.

Generally, the area of possible ball positions $B_{real}$ becomes smaller if the distance between the tracking position $p_{TR}$ and the array increases, if the ball velocity $v_{BALL}$ decreases, or if the maximum latency of the tracker becomes smaller. Further, also the tracking accuracy can be incorporated into the beam width control, wherein the more inaccurate the tracking is, the stronger the beam width is to be increased. Vice versa, the more accurate the tracking is known to be, the narrower can the beam be. The smaller the calculated area $B_{real}$ of possible ball positions is, the narrower is the beam and the less unwanted ambient sound is captured. Therefore, the increased focusing according to the invention leads to an improved audio signal quality.

Figure 3:
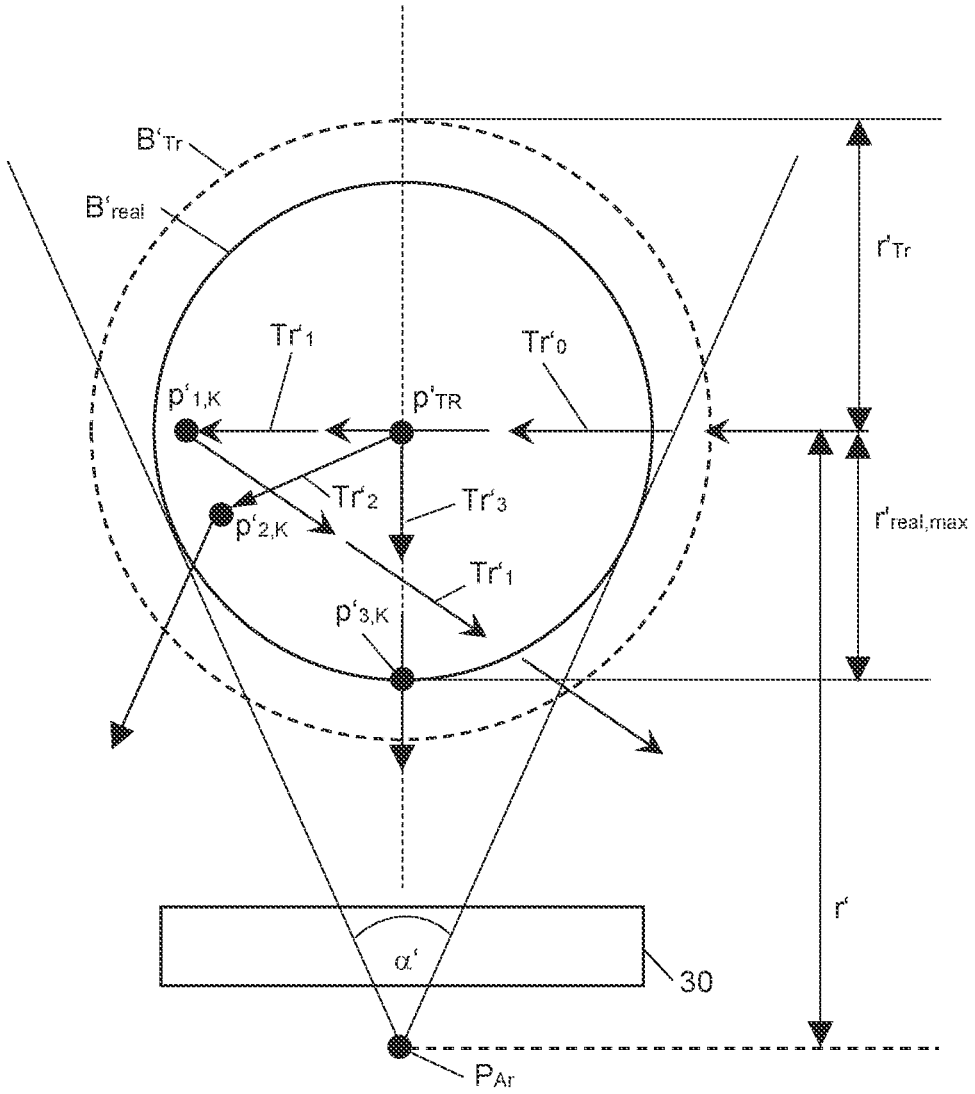
FIG. 3 illustrates a top view of a playing field in a second situation.

FIG. 3 shows a top view on a playing field in a second situation. The distance r' between the tracking position p'TR and the array $P_{Ar}$ is larger here than in FIG. 2. However, the tracking latency $d_{TRACK}$ is the same, so that the area $B'_{real}$ of possible ball positions is smaller than in FIG. 2, while the conventionally (i.e. without considering sound propagation) calculated area $B'_{Tr}$ of the possible ball positions remains unchanged. This results also in a reduced beam width, or reduced angle respectively. For example, $\alpha'\approx 14°$ results for r'=15 m if the other conditions and values remain. However, a conventional calculation (without considering the sound propagation) results in a larger angle of $\alpha'$ 23° in this case.

A basic idea of the disclosed beam width control is that, between the occurrence of the sound event at the sound source and the arrival of the sound at the microphone array, a certain time has lapsed, during which the sound source has already moved.

Figure 4:
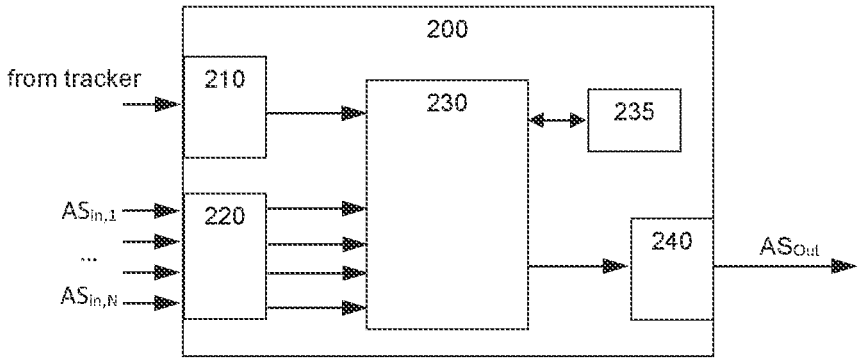
FIG. 4 illustrates a block diagram of a device according to the invention.

FIG. 4 shows a block diagram of a device according to the invention, in an embodiment. The device 200 comprises a first input interface 210 for position information including at least the position $p_{TR}$ and the velocity of a moving object 10. The position information may be received from a tracking system. The device 200 also comprises a second input interface 220 with a plurality of inputs for microphone signals $AS_{in,1}$, . . . , $AS_{in,N}$ that may be received from a plurality of microphone capsules. The device 200 further comprises a processing unit 230 adapted for calculating a directional characteristic or beam pattern from the plurality of microphone signals by using beamforming, wherein the directional characteristic or beam pattern has at least one preferred direction of high sensitivity according to the position information. Thus, the directional characteristic or beam respectively can be directed to the position received from the tracking system in order to capture the sound arriving from this direction. Thereby, an audio output signal $AS_{Out}$ is generated that comprises the sound from the preferred direction of high sensitivity and that can be output via an output interface 240. The processing unit 230 recalculates the directional characteristic or beam at least for each newly received position information. Updated position information may be received from the tracking system in regular time intervals of, for example, 40 ms up to 100 ms. The distance r between the tracking position and the position of the microphone array is considered for the calculation by forming a beam that is as narrow as possible at least for large distances $r>r_{MAX}$, as described above. Known methods are used for the beamforming, such as delaying, summing and/or filtering of the microphone signals.

For smaller distances $r<r_{MAX}$ however, the width or (azimuthal) angle of the directional characteristic is variable and depends on the velocity of the moving object 10, such that a higher velocity of the moving object 10 leads to a larger width or larger opening angle respectively of the directional characteristic. A minimum width or minimum opening angle respectively is obtained for $r=r_{MAX}$. The minimum width or minimum opening angle is not undershot and may be in a range of 5°-10°, for instance. The variable directional characteristic may be generated e.g. by modifying filters of a filter-and-sum beamformer. For this, modified filter coefficients that may be retrieved from a memory 235 in which they are stored may be used. For changing the direction, the individual delay values for the single microphone signals may be modified. In an embodiment, suitable delay values according to the direction may also be retrieved from the memory 235. For other types of beamformers, other values that determine the beam width or opening angle respectively may be modified, such as e.g. weighting factors for Ambisonics signals in a modal beamformer.

Figure 5:
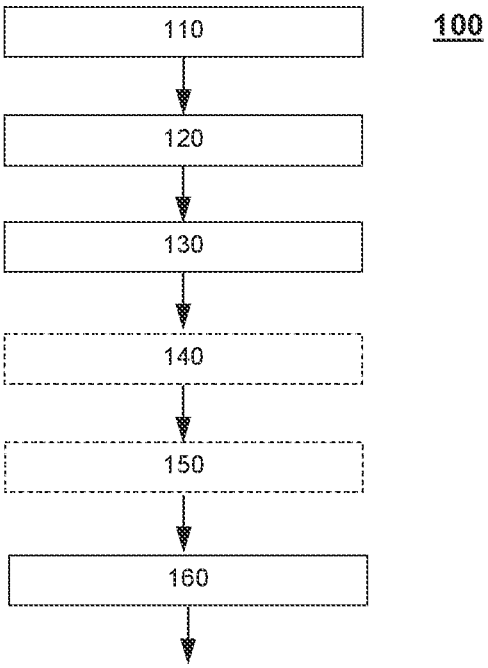
FIG. 5 illustrates a flow-chart of a method according to the invention.

FIG. 5 shows a flow-chart of a method according to the invention, in an embodiment. It is an automatically executed method 100 for controlling a microphone array 40. The method comprises steps of receiving 110 positional information including a position $p_{TR}$ and a velocity of a moving object 10 from a tracking system, and receiving 120 a plurality of microphone signals $AS_{in,1}, \ldots, AS_{in,N}$ from a plurality of microphone capsules. The microphone signals comprise sound of a sound event emanating from the moving object 10. In the next step, a directional characteristic or beam pattern is calculated 130 from the plurality of microphone signals, wherein the directional characteristic or beam pattern is based on beamforming and has at least one preferred direction of high sensitivity, according to the positional information. An audio output signal $AS_{Out}$ that comprises the sound coming from the preferred direction of high sensitivity is generated and then output 160. As described above, the width or opening angle $\alpha$ of the directional characteristic varies over time and depends on the velocity of the moving object 10, with a higher velocity of the moving object leading to a larger beam width or larger opening angle of the directional characteristic respectively, and vice versa.

In one embodiment, the width or opening angle respectively of the directional characteristic is modified 140 also dependent from the tracking latency, wherein a larger tracking latency leads to a larger beam width or larger opening angle of the directional characteristic, and vice versa. In a further embodiment, the width or opening angle is modified 150 also in dependence of the distance between the moving object 10 and the microphone array, wherein a larger distance leads to a smaller width or smaller opening angle of the directional characteristic respectively, and vice versa, and wherein the width or opening angle of the directional characteristic remains above a given non-zero minimum value.

In an embodiment, various of the microphone capsules are in different microphones, each with a directional characteristic, wherein the opening angle of the directional characteristic of the microphone array is calculated and variable in only one dimension (e.g., azimuth angle), while it is predetermined by the directional characteristic of the microphones in another dimension (e.g., elevation angle) where it remains unchanged over time.

In an embodiment, updated positional information is received 110 in regular time intervals of up to 100 ms from the tracking system, which may be video based for instance, and the width or opening angle $\alpha$ respectively of the beam is adapted to the updated positional information.

In embodiments, the invention may be implemented by a software configurable computer or processor. The computer or processor may be configured by instructions stored on a computer-readable non-transient storage medium. The instructions when executed on the computer or processor cause the computer or processor to execute the steps of the method described above.

The invention is in particular advantageous for usage in sports fields or sports stadiums in general, not only for soccer. However, it is clear that the invention may also be used in venues other than a sports stadium. While various different embodiments have been described, it is clear that combinations of features of different embodiments may be possible, even if not expressly mentioned herein. Such combinations are considered to be within the scope of the present invention.

The invention claimed is:

1. A method for controlling a microphone array, comprising receiving from a tracking system position information including a position and a velocity of a moving object;

receiving a plurality of microphone signals from a plurality of microphone capsules, the microphone signals comprising sound of a sound event emanating from the moving object;

calculating of a directional characteristic from the plurality of microphone signals, wherein the directional characteristic is based on beamforming and has at least one preferred direction of high sensitivity corresponding to the position information, and wherein an audio output signal is generated that includes the sound coming from the preferred direction of high sensitivity; and providing the audio output signal at an output;

wherein a beam width or opening angle of the directional characteristic is variable over time and depends on the velocity of the moving object, wherein a higher velocity of the moving object results in a larger beam width or larger opening angle of the directional characteristic.

2. The method according to claim 1, wherein the tracking system has a tracking latency that corresponds to a time duration between measuring the position information and receiving the measured position information at the microphone array, and wherein the beam width or opening angle of the directional characteristic depends also from the tracking latency, wherein a larger tracking latency leads to a larger beam width or larger opening angle of the directional characteristic.

3. The method according to claim 1, wherein the beam width or opening angle of the directional characteristic depends also from a distance between the moving object and the microphone array, wherein a larger distance leads to a smaller beam width or smaller opening angle of the directional characteristic, and wherein the beam width or the opening angle of the directional characteristic remains above a given minimum value.

4. The method according to claim 1, wherein the microphone capsules are in different microphones, each having a directional characteristic, and wherein the beam angle or opening angle of the directional characteristic is calculated and variable only in one dimension while in another dimension it is determined by a directional characteristic of the microphones.

5. The method according to claim 1, wherein updated positional information is received in regular time intervals of up to 100 ms from the tracking system, and wherein the beam width or the opening angle of a beam of the directional characteristic is adapted to the updated positional information.

6. The method according to claim 1, wherein the tracking system is video-based.

7. The method according to claim 1, wherein the moving object is a ball, a moving playing device or a moving sports device.

8. A computer-readable non-transitory storage medium having stored thereon computer-readable instructions that when executed on a computer or processor cause the computer or processor to execute the method of claim 1.

9. A device for controlling a microphone array, the device comprising a first input interface for position information, the position information comprising a position and a velocity of a moving object;

a second input interface comprising a plurality of inputs for microphone signals coming from a plurality of microphones;

a processing unit configured for calculating a directional characteristic from the plurality of microphone signals, wherein the directional characteristic is based on beamforming and has at least one preferred direction of high sensitivity corresponding to the position information, and wherein an audio output signal comprising sound from the at least one preferred direction of high sensitivity is generated; and an output interface for providing the audio output signal;

wherein a width or an opening angle of the directional characteristic is variable over time and depends on the velocity of the moving object, wherein a higher velocity of the moving object leads to a larger width or larger opening angle of the directional characteristic.

10. The device according to claim 9, wherein the position information relates to a first point in time at which it was measured, and wherein the sound from the at least one preferred direction of high sensitivity results from a sound event that occurred at a second point in time different from the first point in time.

11. The device according to claim 9, wherein the width or the opening angle of the directional characteristic depends also from the distance between the moving object and the microphone array, wherein a larger distance results in a smaller width or smaller opening angle of the directional characteristic, and wherein the width or opening angle of the directional characteristic remains above a given minimum value.

12. The device according to claim 9, wherein the microphone capsules are in different microphones, each having a directional characteristic, and wherein the width or opening angle of the directional characteristic is calculated in only one dimension, while in another dimension it is determined by a width or an opening angle of the microphones.

* * * * *